United States Patent [19]

Koukourou

[11] Patent Number: 4,788,809

[45] Date of Patent: Dec. 6, 1988

[54] BUILDING FOUNDATION

[75] Inventor: Peter S. Koukourou, Norwood, Australia

[73] Assignee: Koukourou & Partners Pty. Ltd., Norwood, Australia

[21] Appl. No.: 28,166

[22] Filed: Mar. 19, 1987

[51] Int. Cl.[4] ..... E04B 1/16

[52] U.S. Cl. ..... 52/741; 52/321; 52/323; 52/577; 52/742; 52/677

[58] Field of Search ..... 52/320–325, 52/577, 444, 741, 743, 742, 677

[56] References Cited

U.S. PATENT DOCUMENTS

| | | | |
|---|---|---|---|
| 1,007,557 | 10/1911 | Graham | 52/577 X |
| 1,760,027 | 5/1930 | Venzie | 52/323 |
| 3,389,521 | 6/1968 | Gregori | 52/577 X |
| 4,213,281 | 7/1980 | Zarzosa-Castilia et al. | 52/323 |

FOREIGN PATENT DOCUMENTS

| | | | |
|---|---|---|---|
| 823063 | 11/1951 | Fed. Rep. of Germany | 52/323 |
| 1525178 | 8/1968 | France | 52/323 |
| 392171 | 5/1933 | United Kingdom | 52/321 |

*Primary Examiner*—David A. Scherbel
*Assistant Examiner*—Richard E. Chilcot, Jr.
*Attorney, Agent, or Firm*—Michael P. Breston

[57] ABSTRACT

A method of forming a foundation having intersecting beams and floor portions, comprises leveling the ground on which the foundation is to be located. A plurality of inverted hollow members are positioned in rows. The hollow members are separated by spacers. Lower reinforcing rods are positioned on the spacers and between the hollow members. A reinforcing mesh is laid over the hollow members, and concrete is poured into the channels between and over the hollow members so as to envelope the reinforcing rods and the mesh.

3 Claims, 2 Drawing Sheets

FIG 1
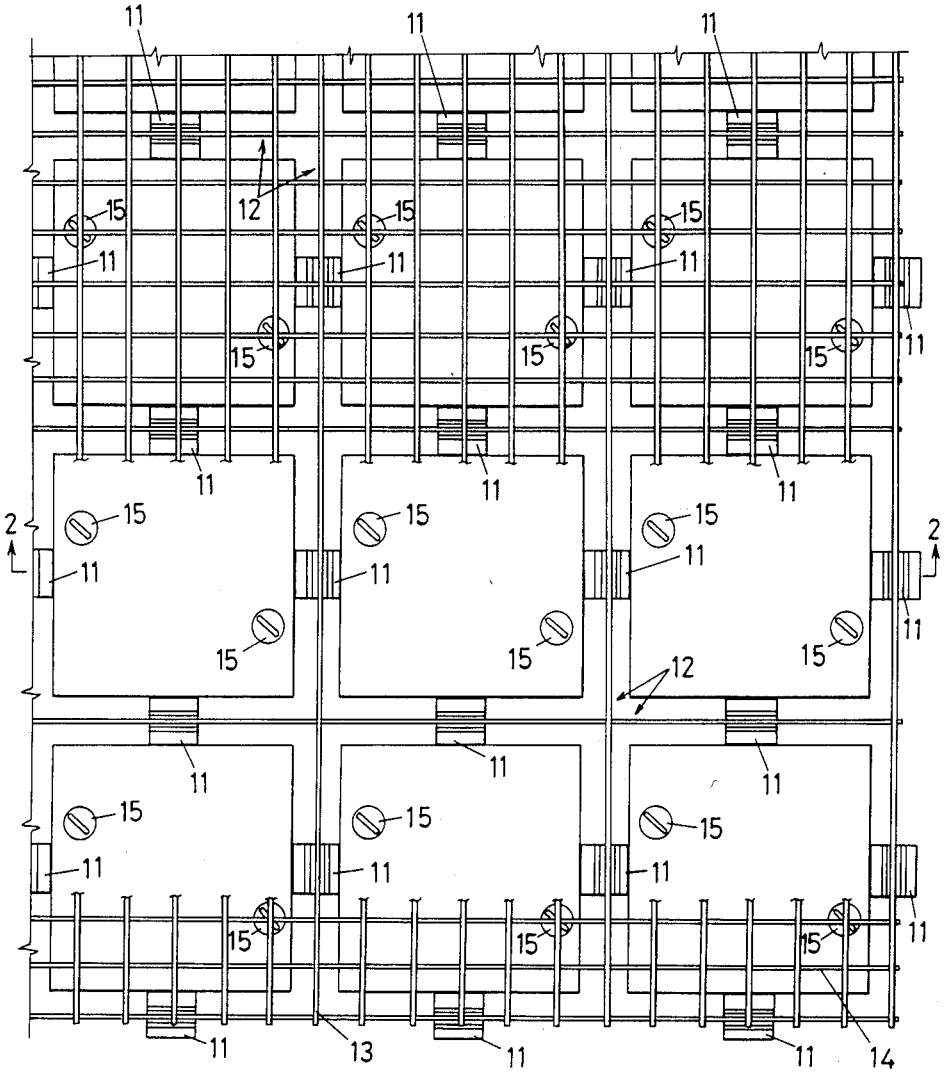
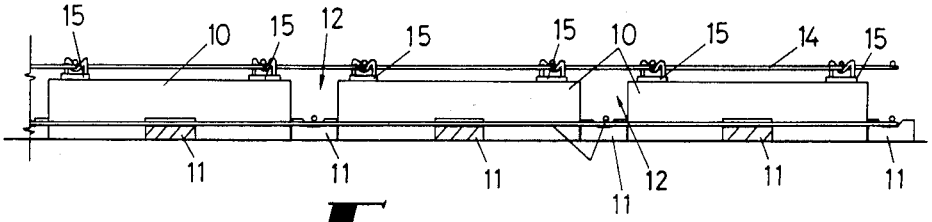
FIG 2

BUILDING FOUNDATION

BACKGROUND OF THE INVENTION

1. Field of the Invention

This invention relates to a method of forming a foundation.

This invention also relates to a building foundation made by such a method. The building foundation is suitable for use on both stable as well as on some unstable ground supports.

2. Description of the Prior Art

The usual practice for constructing a foundation is to excavate a number of trenches, position reinforcing rods and reinforcing mesh in and over the trenches, and then pour concrete to embed the reinforcing rods to be contained within the trenches and to cover the surrounding areas.

Not only is this known process expensive, but when unstable soil is required to support the foundation, there is a high degree of probability that the foundation will crack if the effective volume of soil under the foundation varies with moisture content variation, as is typical in moist climates.

In order to simplify the pouring of foundations, it is known to contain voids or hollows within the foundations so as to form a "waffle grid" with the deep foundation beams being separated by voids. A search revealed Australian Pat. No. 505760 (15904/76) in the name of PLAN-TEK A/S. This appears to be the most relevant art disclosed by the search, or otherwise known to the applicant, but it is related to box-shaped components assembled in a prestressed rigid disc or plate by means of non-embedded prestressed tensioning rods.

SUMMARY OF THE INVENTION

The present invention is directed to embedded rods in a "waffle grid" type foundation, and its main object is to maintain relatively low cost foundation construction, while still retaining a foundation of such high integrity that it can be used in certain instances even over unstable soils.

The novel method of forming a foundation comprises first leveling the ground on which the foundation is to be located, positioning shuttering walls around the hollow members to define the perimeter of the foundation, positioning a plurality of inverted hollow members in rows, separating the hollow members by spacers, positioning lower reinforcing rods on the spacers and between the hollow members, laying a reinforcing mesh over the hollow members, and pouring concrete into the channels between and over the hollow members so as to embed the reinforcing rods and the mesh. The method of this invention produces a foundation having a plurality of intersecting connecting beams and floor portions therebetween.

The foundation which is constructed by the invention comprises a number of spaced hollow members. A number of reinforcing rods lie between the hollow members and are supported by spacer members. A mesh grid covers the hollow members and the reinforcing members. The mesh grid and the hollow members are completely overlaid with a monolithic casting of concrete.

BRIEF DESCRIPTION OF THE DRAWINGS

FIG. 1 is a fragmentary plan showing a stage in the forming of a foundation;

FIG. 2 is a section on line 2—2 of FIG. 1;

DETAILED DESCRIPTION OF A PREFERRED EMBODIMENT

A plurality of five- or six-sided baffled hollow members 10 are arranged (if five-sided) concave side down in rows but spaced apart by some concrete bricks 11 so as to form a number of intersecting channels 12 between the hollow members, and also to support a number of lower reinforcing rods 13.

Figure 3:
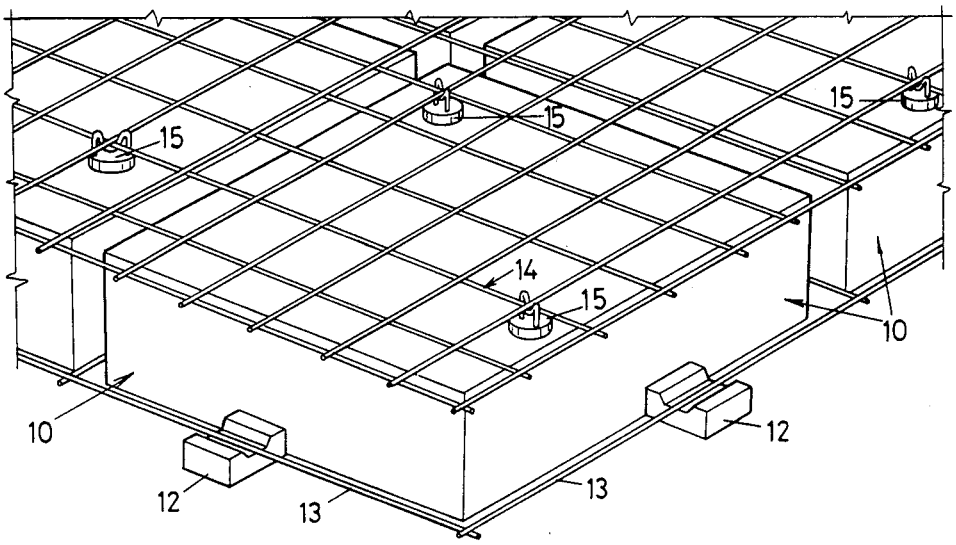
FIG. 3 is a fragmentary perspective (not showing peripheral shuttering)
Figure 4:
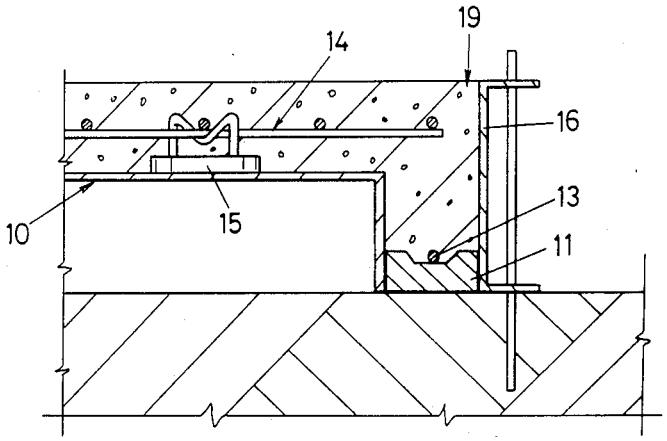
FIG. 4 is a fragmentary section to a larger scale and showing shuttering.

The bricks 11 firmly hold the members in place. The upper surfaces of bricks 11 contain grooves, as best seen in FIG. 4, to position the rods 13 centrally.

The hollow members 10 are formed from a stiff waterproof cardboard containing internal baffles for strength, or from a rigid foamed polymeric material, each of which has a characteristic of providing good heat insulating properties and is sufficiently rigid to support fluent concrete when poured over the reinforcing members and over the hollow members.

A mesh 14 of upper reinforcing rods covers the hollow members 10. Mesh 14 is supported by spaced-apart support chairs 15. Peripheral shuttering walls 16 define the perimeter of the foundation (shown only in FIG. 4).

If, when the concrete is poured, there is any tendency for the hollow members 10 to float, this is resisted by grid 14 which applies a downward force and inhibits such floating. The possible tendency to float is further resisted by spacers 11 which are located between the down-turned flanges of the hollow members 10.

Furthermore, each one of the hollow members 10 can define a central depression (not shown) which can receive concrete that will further weigh down the hollow members.

After the initial assembly has taken place, concrete 19 is poured into the channels and arranged to cover hollow members 10, and at the same time to envelop all the reinforcing members. Since bricks 11 are also formed of concrete, they are adhesive to the poured concrete, and ingress of air moisture to the reinforcing rods is inhibited, allowing the foundation to have considerable integrity from a structural point of view.

The foundation is freely positioned on its supporting ground, and is well reinforced against deflection either concave or convex upwardly. Therefore, if applied to unstable soils, the foundation will tolerate some movement of the soil beneath it. Thus the foundation can be used under certain types of conditions which are normally unsuitable for the types of foundations previously used.

Because of the simplicity of construction when following the method of this invention, the labor cost to erect a foundation is much less than with previously used foundations. Also, a high degree of insulation is imparted both by the material comprised in the inverted hollow members and by the air pockets within the hollow members. This insulation has a significant beneficial effect on energy conservation.

The channels 12 between the hollow members 10 can also be used for carrying conduits, plumbing pipes, and the like, without having any marked effect on the overall strength of the foundation.

What is claimed is:

1. A method of forming a building foundation, comprising:

leveling the supporting ground;

positioning a number of hollow members in rows on the ground;

positioning shuttering walls around the hollow members to define the perimeter of the foundation;

placing spacers on the ground between adjacent ones of said hollow members and between said shuttering walls and the hollow members to retain the hollow members in place;

placing lower reinforcing rods on the spacers in two rows at an angle to each other;

placing reinforcing bar support chairs on the hollow members;

positioning a mesh of upper reinforcing rods on the support chairs; and pouring concrete to envelop said spacers, said lower reinforcing rods, said hollow members, said support chairs, and said reinforcing mesh, thereby forming a foundation having a reinforced slab and a number of intersecting reinforcing beams.

2. A method of forming a building foundation according to claim 1, in which said spacers themselves comprise grooves in their upper surfaces, and further comprising:

locating said lower reinforcing rods in said grooves.

3. A method of forming a building foundation according to claim 1, in which each said hollow member is formed from stiff waterproof cardboard and has five sides, and further comprising:

positioning the hollow members concave side down.

* * * * *